US008885860B2

(12) United States Patent
Djalilian et al.

(10) Patent No.: US 8,885,860 B2
(45) Date of Patent: Nov. 11, 2014

(54) DIRECT DRIVE MICRO HEARING DEVICE

(75) Inventors: Hamid R. Djalilian, Irvine, CA (US); Mark Bachman, Irvine, CA (US); Mark Merlo, Irvine, CA (US); Peyton Paulick, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 77 days.

(21) Appl. No.: 13/487,597

(22) Filed: Jun. 4, 2012

(65) Prior Publication Data

US 2012/0308062 A1 Dec. 6, 2012

Related U.S. Application Data

(60) Provisional application No. 61/492,646, filed on Jun. 2, 2011.

(51) Int. Cl.
*H04R 25/00* (2006.01)

(52) U.S. Cl.
CPC ..... *H04R 25/606* (2013.01); *H04R 2225/31* (2013.01); *H04R 25/554* (2013.01); *H04R 25/652* (2013.01); *H04R 25/453* (2013.01); *H04R 2225/61* (2013.01); *H04R 2430/21* (2013.01); *H04R 25/407* (2013.01); *H04R 2460/17* (2013.01); *H04R 25/658* (2013.01); *H04R 25/456* (2013.01)
USPC ..... 381/326; 381/312; 181/128

(58) Field of Classification Search
USPC ..... 381/312, 313, 326, 328, 381, 151, 329, 381/23.1; 181/128–130; 600/25
See application file for complete search history.

(56) References Cited

U.S. PATENT DOCUMENTS 6,643,378 B2 * 11/2003 Schumaier ..... 381/326
6,940,989 B1 * 9/2005 Shennib et al. ..... 381/326

* cited by examiner

*Primary Examiner* — Curtis Kuntz
*Assistant Examiner* — Sunita Joshi
(74) *Attorney, Agent, or Firm* — K&L Gates LLP

(57) ABSTRACT

A device and methods are provided for a hearing device. In one embodiment, a hearing device includes a microphone to receive sound, an interactive tip and actuator. The actuator can include an actuator element and preload force element to place the interactive tip in contact with a portion of an ear. The hearing device includes circuitry coupled to the microphone and actuator, the circuitry configured to process sound received by the microphone and drive the actuator based on processed sound, wherein the actuator drives the interactive tip relative to a portion of the ear based on one or more signals received from the circuitry.

24 Claims, 16 Drawing Sheets

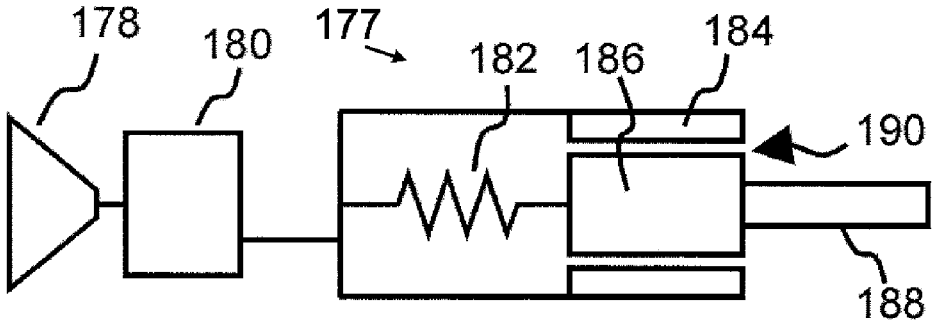
*FIG. 11*
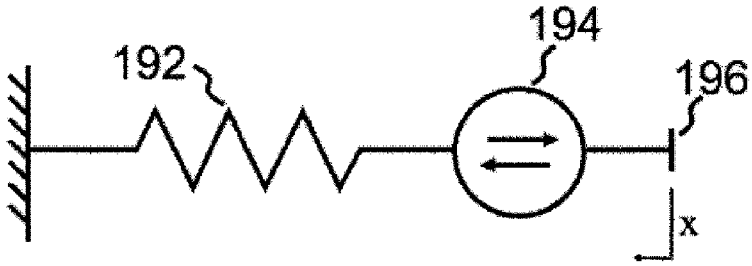
*FIG. 12*
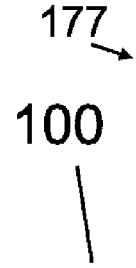

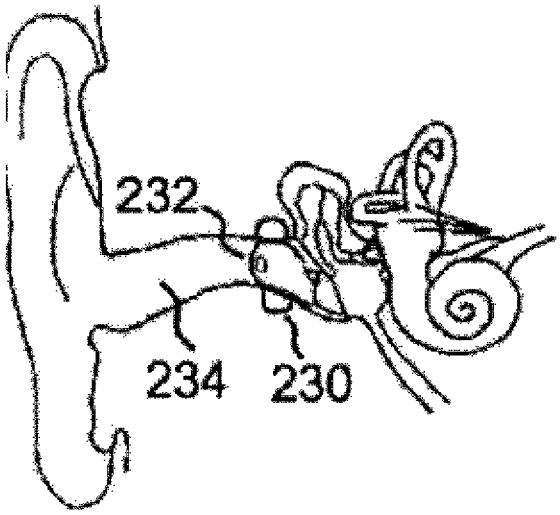
*FIG. 14A*
*FIG. 14B*
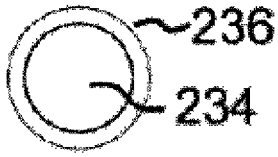
*FIG. 14C*
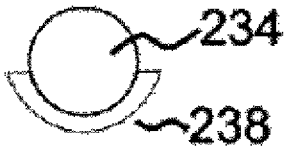
*FIG. 14D*
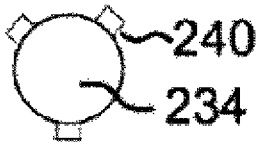

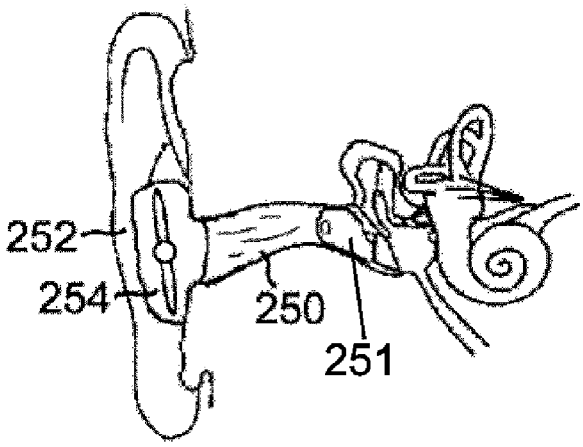
*FIG. 15*
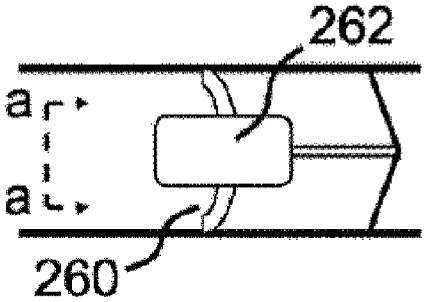
*FIG. 16A*
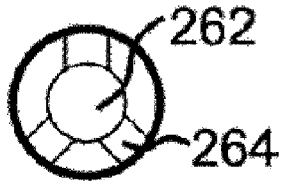
*FIG. 16B*
*FIG. 16C*
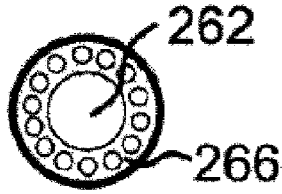

DIRECT DRIVE MICRO HEARING DEVICE

CROSS-REFERENCE TO RELATED APPLICATION

This application claims priority to U.S. Provisional Application No. 61/492,646 filed Jun. 2, 2011, the disclosure of which is hereby incorporated by reference.

FIELD

The present disclosure relates to a hearing device and, more particularly, to a device that can mechanically drive the ossicular chain while being located in the ear.

BACKGROUND

Conventional hearing aids rely on amplification of sound to improve hearing. This approach has several disadvantages. First, acoustic energy applied to the ear canal results in the occlusion effect, which occurs when bone-conducted sound energy trapped within the ear canal vibrates the cartilaginous portion, and results in unnatural sound quality due to an increased low frequency gain. This unnatural sound quality is especially bothersome to people with mild hearing loss. The occlusion effect increases with the volume of trapped air within the ear canal. Second, the output sound energy from the speaker may escape and re-enter the microphone, causing feedback when the amplification from microphone to speaker is greater than the attenuation from speaker to microphone. The problem of feedback is particularly problematic in patients with moderate or severe hearing loss where significant amplification is required, especially in the high-frequency region. It is also a problem for miniaturized devices where the microphone and acoustic driver are close together.

Some hearing aids attempt to solve the occlusion effect by adding a vent to the earmold to allow sounds trapped in the ear canal to escape. A larger vent diameter and shorter vent length would be more effective in reducing occlusion. However, a tradeoff of a larger vent diameter and short vent length is that such a vent provides less attenuation from a speaker to a microphone and thus, increases the likelihood of feedback. The problem feedback is overcome by increasing the separation between the microphone and speaker, usually by increasing the size of the hearing aid (in order of increasing size and visibility) from completely-in-the-canal to in-the-canal to in-the-ear to behind-the-ear. Patients, however, generally do not want to wear larger hearing aids due to their appearance and attached stigma. Although digital feedback management techniques can be applied, the state-of-the-art feedback management algorithms lead to signal degradation.

Micro hearing aids have been developed, but they suffer from the feedback problem just described. One of the newer hearing aids on the market (Lyric, InSound Medical Inc.) is small enough to be inserted deep into the bony part of the ear canal without being visible. The device eliminates the stigma attached to hearing aids and reduces the occlusion effect by reducing the amount of sound generated in the ear canal. However, due to feedback problems associated with a short distance between microphone and speaker, the micro hearing aids are typically only suitable for persons with mild hearing loss who do not require high amplification.

Alternatives to conventional hearing aids include the semi-implantable, implantable or fully implantable middle ear transducer. An early device (Direct System, Soundtec Inc.), now withdrawn from the market, consisted of a magnet attached to the ossicles (incudostapedial joint). The magnet was driven by an electromagnetic field produced by the external unit, consisting of a deeply fitted earmold housing an inductive coil, held approximately 2 mm lateral to the tympanic membrane, and a behind the ear (BTE) device housing the other electronic parts. The Vibrant Soundbridge (Med-El Corp.) consists of two parts attached by magnets—an implanted part consisting of the receiving coil, electronics and transducer, and an external part housing the microphone, speech processor, battery and transmitting coil. The Carina (Otologics LLC), which is available in Europe and currently under clinical trial in the US, is fully implantable. These devices translate sound energy into mechanical energy via a piezoelectric actuator that directly drives the ossicular chain. By having a mechanical rather than an acoustic output, the problem of acoustic feedback is eliminated. By driving the ossicles directly, the device may eliminate the occlusion effect and can provide a better sound quality compared to conventional hearing aids. However, major disadvantages of these devices that have reduced their acceptance include prohibitive cost, the need for an invasive surgery, the need for a second device with a microphone, and the requirement of an additional surgery for removal if there is a problem with the device. On the positive side, clinical studies showed that most patients preferred the sound quality of their middle ear implant over their hearing aid and thought that the feedback problem had been resolved.

The current state of art does not provide a satisfactory way to restore hearing without one or more of the follow disadvantages; feedback, occlusion effects, easily visible, stigma, invasive surgery, expensive and/or surgery for removal. Thus, there exists a desire for a device which overcomes one or more of the aforementioned drawbacks.

BRIEF SUMMARY OF THE EMBODIMENTS

The various embodiments provided herein are generally directed to systems and methods for a hearing device that is placed in the ear to drive a portion of an ear, such as the ossicular chain. In one embodiment, a hearing device includes a microphone configured to receive sound, an interactive tip and an actuator including an actuator element and preload force element, the preload force element configured place the interactive tip in contact with a portion of an ear. The hearing device also includes circuitry coupled to the microphone and actuator, the circuitry configured to process sound received by the microphone and drive the actuator based on processed sound. The actuator drives the interactive tip relative to a portion of an ear based on one or more signals received from the circuitry.

Another embodiment is directed to a two-part configuration for a hearing device for an ear including active and passive sections. The active section includes a microphone configured to receive sound and circuitry coupled to the microphone, a first actuator component, and circuitry configured to process sound received by the microphone and drive the first actuator component based on processed sound. The passive section, which is separate from the active section, includes an electromagnetic actuator and interactive tip. The electromagnetic actuator of the passive section is driven by the first actuator to drive a portion of the ear based on one or more signals received from the circuitry.

Other aspects, features, and techniques will be apparent to one skilled in the relevant art in view of the following detailed description of the embodiments

BRIEF DESCRIPTION OF THE DRAWINGS

Other aspects, features, and techniques will be apparent to one skilled in the relevant art in view of the following detailed description of the embodiments

FIG. 11 depicts a simplified diagram of a hearing aid device configuration according to one or more embodiments;

FIG. 12 depicts a block diagram layout of a preload force and actuator in series according to one embodiment;

FIGS. 14A-14D depict methods of positioning and attaching a device with external components according to one or more embodiments;

FIG. 15 depicts the use of an external fan to help keep the ear canal clean and dry according to one embodiment;

FIGS. 16A-16C depict methods of attaching a device according to one or more embodiments;

DETAILED DESCRIPTION OF EXEMPLARY EMBODIMENTS

Overview and Terminology

Figure 1:
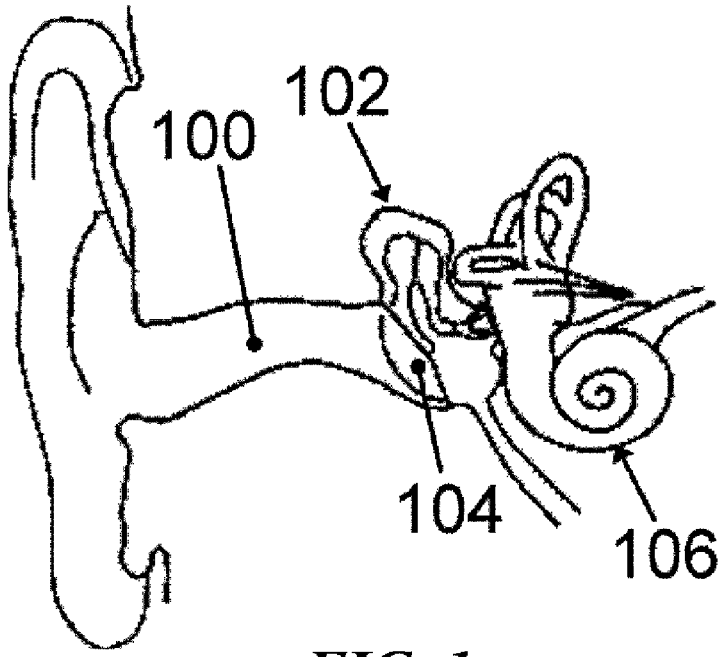
FIG. 1 depicts a sectional view of a typical ear.

One embodiment of the disclosure is directed to a wearable hearing device that is placed in the ear and configured to drive at least one portion of the ear. For example, in one embodiment, a hearing device includes a microphone configured to receive sound and an actuator. The actuator may be a voice coil actuator and can include an actuator element and preload force element. The preload force element can place an interactive tip of the hearing aid device in contact with the portion of the ear. The hearing device may additionally include circuitry coupled to the microphone and actuator, the circuitry configured to process sound received by the microphone and drive the actuator based on processed sound. Based on one or more signals received from the circuitry, the actuator can drive an interactive tip relative to a portion of an ear canal.

In a preferred embodiment, the hearing device is placed deep in the ear canal and drives the ossicular chain at the umbo using a voice coil actuator. This embodiment comprises a microphone, battery, circuitry, charging coil, voice coil actuator, preload spring, housing and interface tip. The preload spring can keep the interface tip in contact with the umbo and allows for a large range of acceptable device placement positions. The sound received by the microphone is processed by the circuitry, which in turn drives the voice coil actuator with the proper mechanical motion to mimic and amplify the sound received.

In one embodiment, a hearing aid device mechanically drives the ossicular chain. According to another embodiment, energy is transferred to the portion of the ear canal by at least one of electronic, electromagnetic, acoustic, photonic, vibration, magnetic, and mechanical means. In yet another embodiment, the portion of the ear receiving the actuation may relate to one of the umbo, tympanic membrane, ear canal and ossicles of a user for perception of the sound.

Further embodiments include additional features and teachings disclosed below and can be utilized separately or in conjunction with other features and teachings to provide a bone conduction device without the need for a protrusion through the skin. Representative embodiments can include many of these additional features and teachings both separately and in combination.

In some instances, the various features of the representative examples provided herein may be combined in ways that are not specifically and explicitly enumerated in order to provide additional useful embodiments of the present teachings.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Referring now to the figures, FIG. 1 depicts a sectional view of a typical ear including ear canal 100, ossicles 102, tympanic membrane 104 and cochlea 106. As discussed herein, a herein device may be placed in ear canal 100 to drive one or more portions of an ear.

Figure 2:
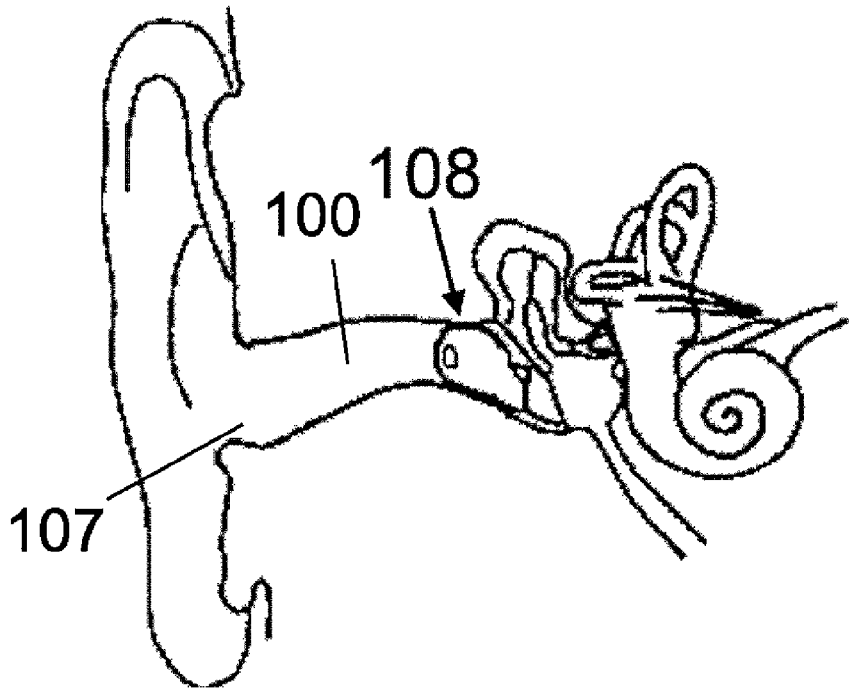
FIG. 2 depicts placement of a wearable hearing device according to one embodiment.

FIG. 2 depicts placement of a wearable hearing device 108 according one or more embodiments. Wearable hearing device 108 may be placed deep in the ear canal so that it cannot be seen. In some situations, it might be acceptable that wearable hearing device 108 is visible and therefore, can extend out of ear canal 100 and in particular out of opening 107 of ear canal 100. In one embodiment, the middle ear is mechanically driven by wearable hearing device 108. Hearing device 108 can be positioned/located near the tympanic membrane 104. Wearable hearing device 108 is not required to be located near the tympanic membrane 104 if an extended mechanical connection is provided between the hearing device and the tympanic membrane.

Figure 3:
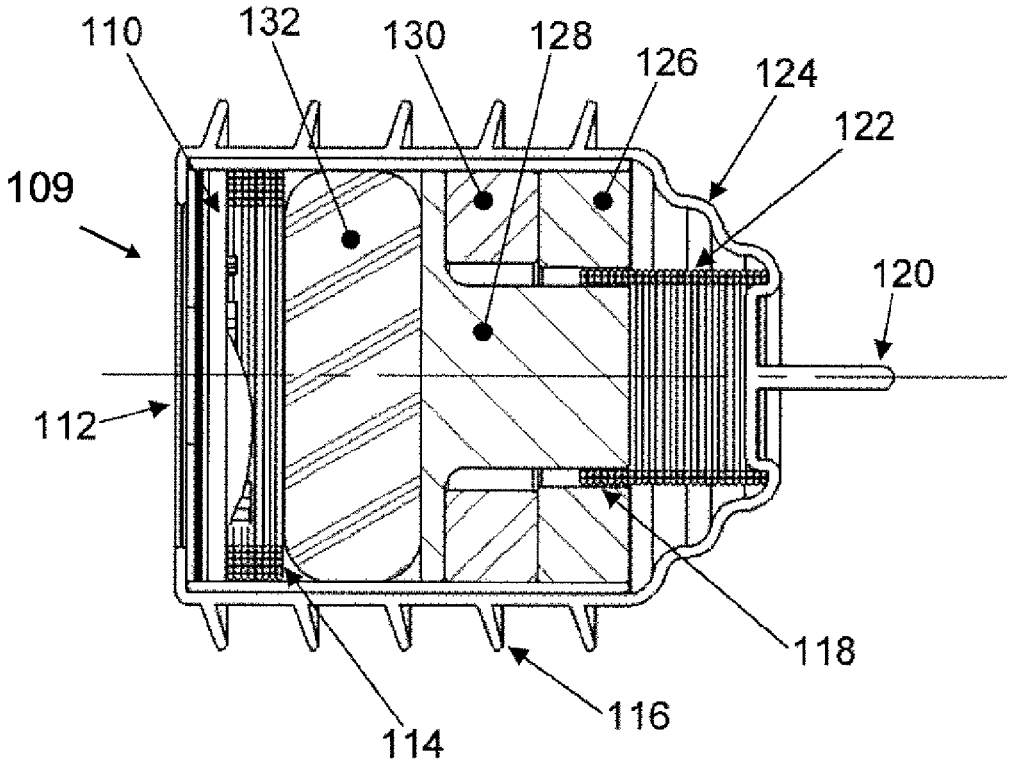
FIG. 3 depicts a cross sectional view of a wearable hearing device according to one embodiment.

Referring now to FIG. 3, a cross sectional view is depicted of a hearing aid device according to one or more embodiments. Hearing aid device 100 includes circuitry 110 which includes one or more elements for signal processing, recharging, programming and additional functions of the hearing aid device. Microphone 112 is located at the end of hearing aid 100 and faces the entrance of the ear canal, opening 107, when worn. In certain embodiments, microphone 112 faces the tympanic membrane. Sound is received by microphone 112 and circuit 110 processes the received sound signal. A voice coil actuator is composed of magnet 130, inner flux guide 128, outer fluxes guide 126 and voice coil 122. Circuit 110 drives current through voice coil 122 and a force is produced along, or at an angle to, the axis of hearing aid device 109 due to its interaction with the magnetic field in air gap 118. In certain embodiments, this force will drive interface tip 120 which will be in contact with a portion of the ear, such as a portion of the ear canal, the tympanic membrane, or the umbo. The portion of the ear, such as the umbo, will displace from these forces and ultimately sound is perceived by the user. Preload spring 114 will hold interface tip 120 in contact with the umbo. Preload spring 114 and the voice coil actuator of hearing aid device 109 configuration is discussed in further detail below with respect to FIG. 5. In certain embodiments, the position of interface tip 120 does not influence force provided by the actuator. The hearing aid device of FIG. 3 may be coated to prevent the device from corrosion and to maintain strength over time. Examples of such coatings include nickel, zinc, or epoxy.

Hearing aid device 109 includes housing 116, the housing providing one or more features to hold the hearing aid device comfortably in place. Housing 116 can be designed in several ways. Hearing device 1000 can include one or more elements to reduce sound from reaching one or more of portions of the ear canal, tympanic membrane, middle ear, or inner ear. In one embodiment, housing 116 may completely seal the ear canal and prevent natural sound from reaching the tympanic membrane. In another embodiment, housing 116 can be designed with baffles to impede sound from reaching the tympanic membrane while allowing the pressure to equalize between both sides of the device. Housing 116 may be designed have no sealing (nonoccluding) and allow free passage of sound. Housing 116 can also be designed to be flexible to allow relative movements between components to allow the device to better conform to the ear canal.

Battery 132 can power the device of FIG. 3 and recharge coil 114 can recharge battery 132. Recharging schemes are discussed in more detail below. In certain embodiments, recharging of hearing aid device 109 is not a requirement for successful implementation of the device.

Figure 4:
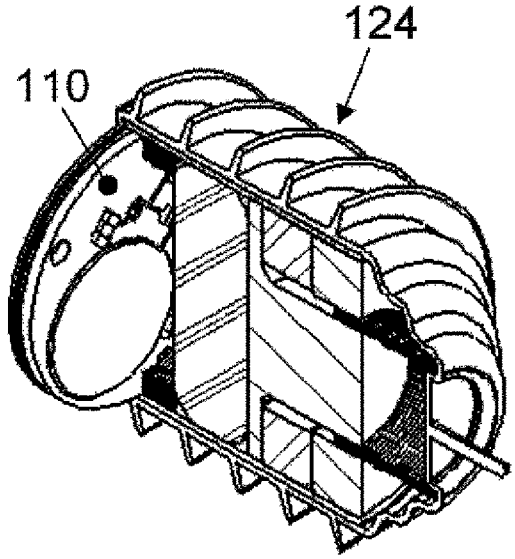
FIG. 4 depicts an isometric view of a hearing device according to one embodiment.

FIG. 4 depicts an isometric view of a hearing aid device, such as the hearing aid device of FIG. 3, according to one or more embodiments. Circuit 110 is not sectioned in FIG. 4 for added clarity on the configuration of the device. A configuration of outer housing 124 is also shown. Housing 124 includes one or more raised portions that can allow for placement of the hearing aid device in an ear canal and in some circumstances block one or more of moisture, fluid, aid and sound from penetrating a portion of the hearing aid including the interface tip when worn.

Figure 5:
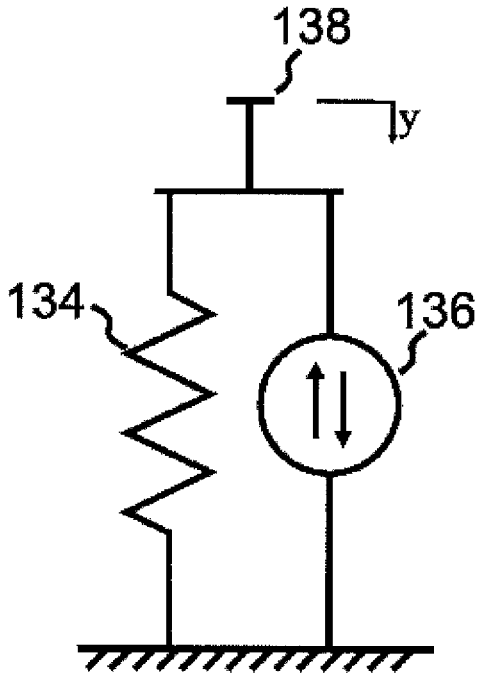
FIG. 5 depicts schematic diagram of an actuator and preload force arrangement according to one embodiment.

FIG. 5 depicts a schematic diagram illustrating an actuator and preload force arrangement according to one or more embodiments. A hearing aid, as discussed herein, can include an actuator, preload force arrangement and interface tip. Schematically, the preload force is displayed as spring 134, the actuator is displayed as force element 136 and the interface tip is labeled 138. When spring 134 is displaced, a force is generated to oppose the direction of motion. The opposing force can be independent of, proportional to, or a complex function of the displacement. Force element 136 allows free movement of interface tip 138 and at any position can provide an arbitrary mechanical output (e.g. force, displacement, velocity). This arrangement decouples the preload force from the actuator, making the properties of each independent of the other. The arrangement enables interface tip 138 to be displaced an arbitrary distance with no effect on the output of the actuator (e.g., force element 136). The arrangement also allows the preload force and actuation force to be very different in magnitude. For example, the preload force can provide 1 mg of force while the actuator provides 1 g of force. If the preload force and actuator were in a series arrangement, this would not be possible since the force of one must react the other.

In one embodiment, the preload force can be provided by a typical spring, in which case the force provided would be proportional to the displacement. The preload force can also be composed of several springs either in series and/or parallel and are configured to provide a tailored force based on a displacement profile. In certain embodiments, the preload force element need not be a separate element. For example, a voice coil according to one or more embodiments of a hearing aid device can provide a preload force using a DC bias and the actuation force would be superimposed onto the DC bias signal, essentially decoupling the two forces. In a similar fashion, a voice coil can provide a complex preload force profile while still providing an independent actuation force.

In certain embodiments, the voice coil actuator and preload force arrangement of FIG. 5 may allow for a hearing aid device to provide a large range of acceptable distances for the hearing aid device to be placed in relation to the tympanic membrane with no influence of the actuation force. The preload force element comfortably holds the interface tip against the tympanic membrane while the actuator drives the tympanic membrane with an arbitrary force. Therefore, the actuator and preload force arrangement eases the requirements of the device placement position and can reduce the chances of tympanic membrane perforation. This arrangement also allows the tympanic membrane to deflect due to outside influences (e.g. pressure differences due to elevation change) without influencing the performance of the actuator. The performance and force generated are also not influenced by the device placement, which is desirable since placement of the device could move either intentionally or unintentionally.

Figure 6:
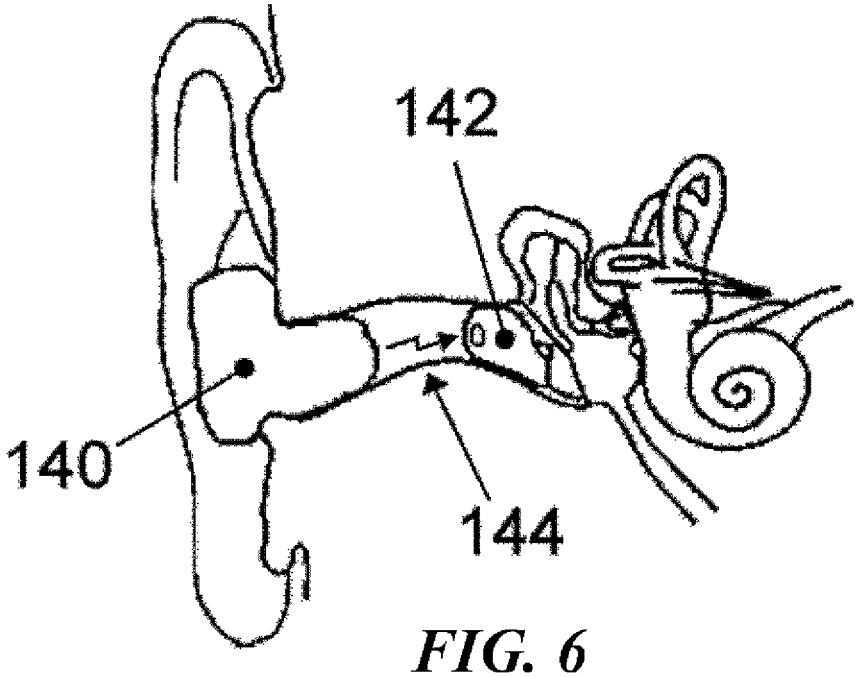
FIG. 6 depicts hearing device charging according to one embodiment.

FIG. 6 depicts a graphical representation of charging a hearing device. According to one embodiment, a hearing device, such as hearing aid device 109 can receive energy from a source placed near and/or in contact with the hearing device. Energy may be transferred by electronic, electromagnetic, acoustic, photonic, vibrational, magnetic, and/or mechanical means. In one embodiment, ear worn unit 140 is placed in an ear and energy 144 is transferred to hearing aid device 142. Once charging is complete, ear worn unit 140 can be removed. Energy 144 can be electromagnetic energy that can be picked up by an inductive coil in device 142. Energy 144 can be light and device 142 will have a solar cell to convert the light to energy. Energy 144 can be sound that oscillates a member on the device to generate electricity. Hearing aid device 142 can be configured to not transfer this sound to the user or it may be outside of the audible range.

Energy 144 can be transferred to hearing aid device 142 via a wired connection, in which case hearing aid device 142 includes a mechanism for easily attaching and removing the wired connection. In one embodiment, ear worn unit 140 may include a mechanism that provides very little force against the device and therefore is unable to move the device position, but still establish a proper electrical connection. A magnetic connector can also be used to implement the method described above.

Figure 7:
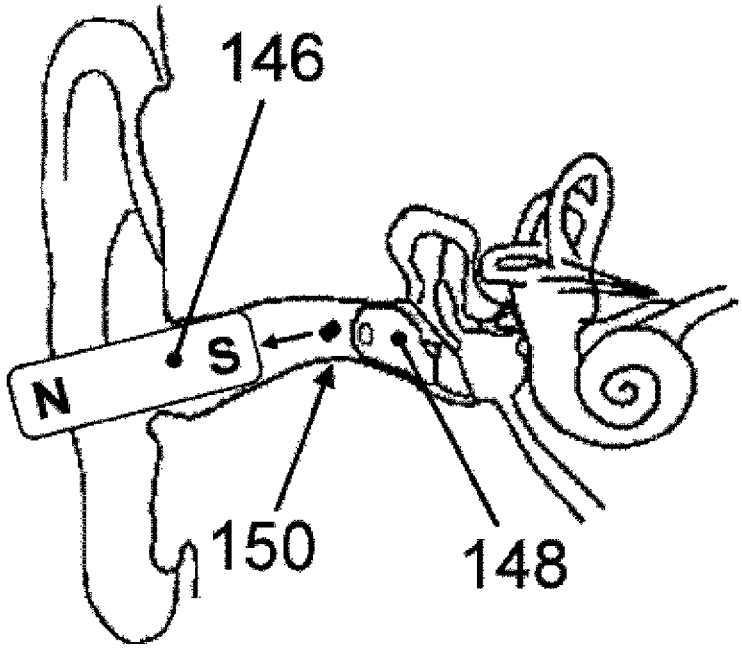
FIG. 7 depicts a process for implementing an emergency stop mechanism according to one embodiment.

FIG. 7 depicts a graphical representation for implementing an emergency stop mechanism, such as a noncontact method for stopping hearing aid device 148. When magnet 146 is placed in the ear, its magnetic field will pull an item, depicted as 150, away from device 148. Item 150 may include a fuse that when removed, prevents the hearing aid device from operating. Magnet 146 can be sized to prevent contact with hearing aid device 148 and to prevent potential damage to the tympanic membrane. Item 150 may also be located in the device. As such, item 150 can my fixed within device 148 to prevent item 150 getting stuck in the ear canal. Alternatively, a reed switch may also replace item 150. In certain embodiments, the device would be designed to not turn on once the reed switch is trip. This will allow magnet 146 to be removed and keep device 148 in the off state.

Figure 8A:
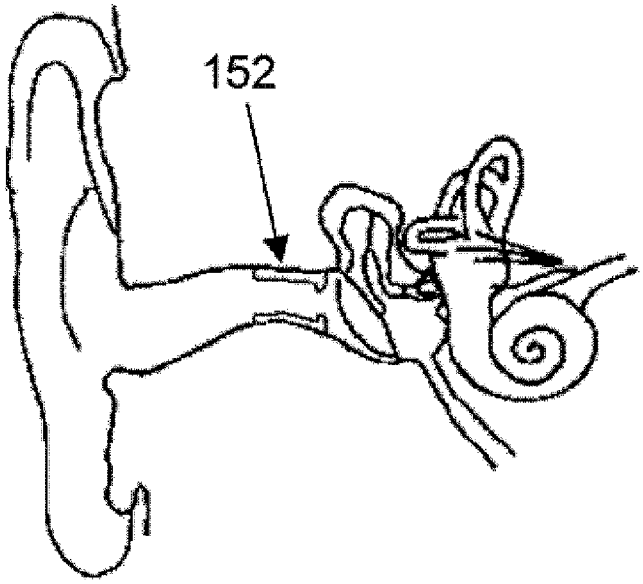
FIGS. 8A-8B depict a system for installing a device using a multi-part system according to one embodiment.
Figure 8B:
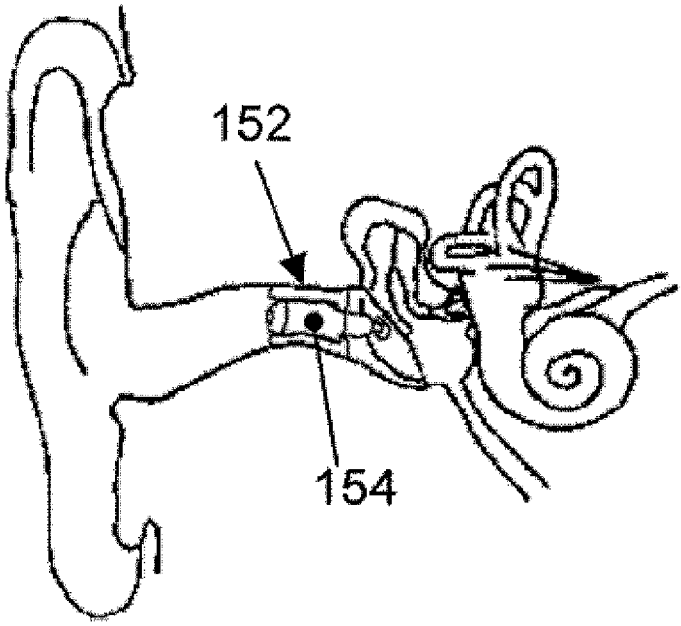

FIGS. 8A-8B depict a system for installing a hearing aid device using a multi-part system. According to one embodiment, insertion of a hearing aid device can be facilitated by using a multipart system including a sleeve for a hearing aid device. In FIG. 8A, a cross sectional view of sleeve 152 can be easily inserted and placed in the ear canal. Sleeve 152 can be made with a large hole through the center, allowing for easy visual inspection. Sleeve 152 is designed to stop component 154 at the proper distance from the tympanic membrane as depicted in FIG. 8B. This enables blind insertion of component 154, such as a hearing aid device, without any risk of inserting it too far into the ear canal. In another embodiment, the interface tip of a hearing aid device can be part of the sleeve. In this case, it is possible to visually inspect the contact of the interface tip with the tympanic membrane/umbo since the sleeve can be made clear or have inspection ports added to it. The second component that is placed blind would consist of the other components of the hearing aid device (e.g. actuator, microphone, electronics).

A number of additional methods can be used to aid in the placement of a hearing aid device. In one embodiment, a hearing aid device can vibrate the interface tip during insertion so the user would hear when the device comes in contact with the tympanic membrane. For visual inspection, a hearing aid device may include one or more of providing a hearing aid device housing that is clear, providing a hole placed through the device, providing a groove placed on the outside of the device, having the device be made smaller than the ear canal diameter, and providing the external part to include a retractable feature. Special placement tools may be designed to assist in the visual inspection during placement using mirrors, cameras, etc.

Figure 9:
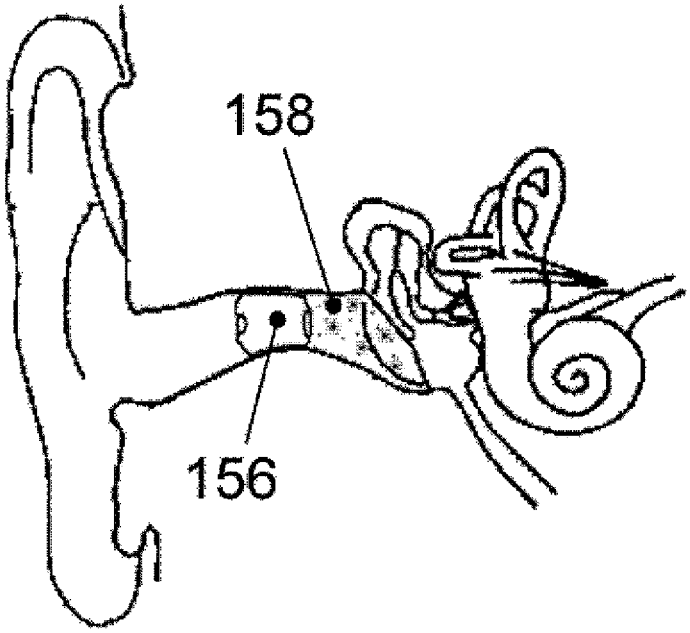
FIG. 9 depicts a hearing aid device configured to interface with the tympanic membrane using fluid according to one embodiment.

FIG. 9 depicts a hearing aid device configured to interface with the tympanic membrane using fluid according to on embodiment. Fluid can be used for mechanically coupling a hearing aid device to the tympanic membrane as depicted in FIG. 9, in which hearing aid device 156 has an actuator that displaces fluid 158. When pressure is produced in fluid 158 by the actuator of hearing aid device 156, the pressure will displace the tympanic membrane and will be perceived as sound by the user. Hearing aid device 156 completely seals the ear canal and prevents fluid 158 from leaking around device 156.

In an alternative embodiment, instead of free fluid between the device and tympanic membrane, a fluid filled pouch can be used that interfaces with the tympanic membrane. Using a fluid filled pouch can eliminate the need for the device to seal the ear canal and can be easier to install since the hearing aid device and fluid are individually contained.

Figure 10A:
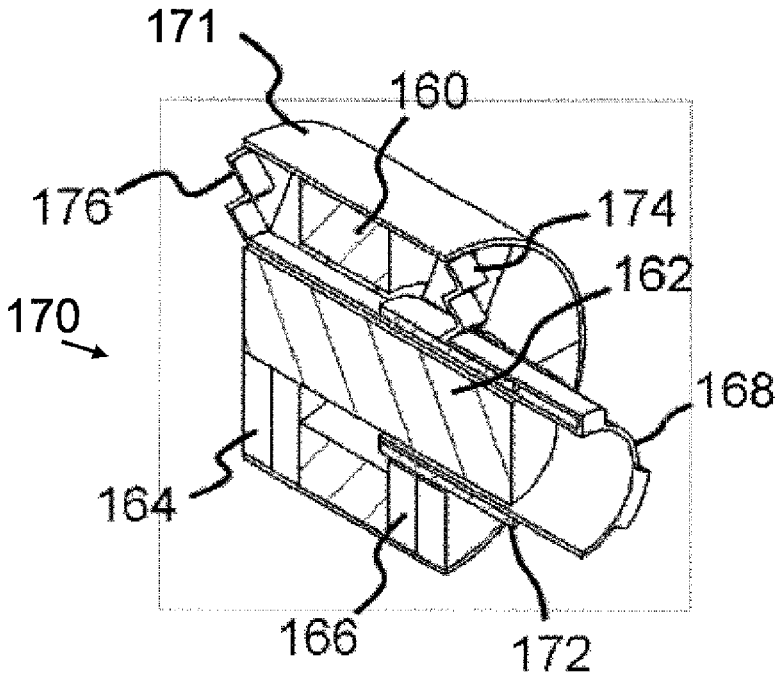
FIGS. 10A-10B depict an actuator according to one or more embodiments.
Figure 10B:
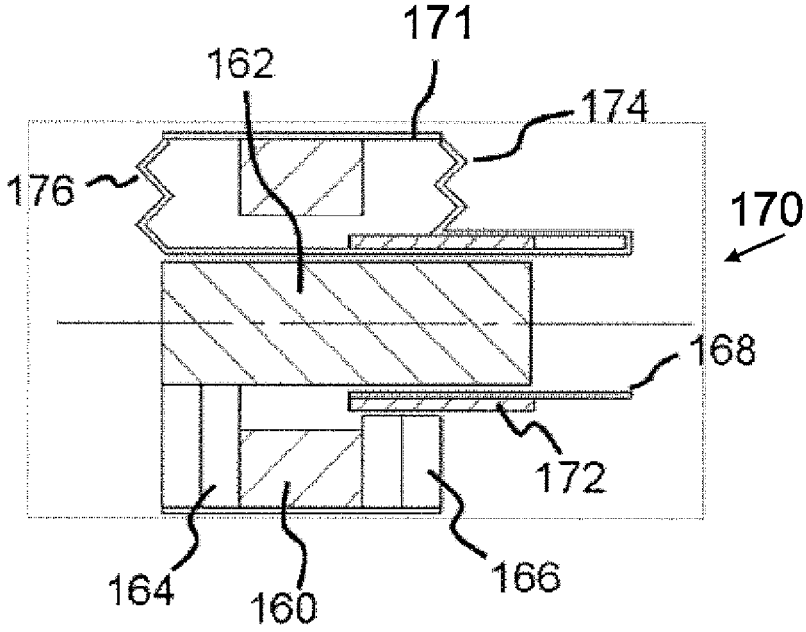

FIGS. 10A-10B depict an actuator according to one or more embodiments. FIG. 10A shows a cross-section of an isometric view of a hearing aid device. FIG. 10B depicts a cross-section of a side view of actuator 170, wherein elements of FIG. 10A correspond to elements of FIG. 10B. Actuator 170 is similar to the actuator described with reference to FIG. 3, however, suspension of voice coil 172 is on both ends. Permanent magnet 160 forms a flux circuit with inner rod 162, flux guide 164 and flux guide 166. An air gap, which may or may not include or be a fluid gap, exists between flux guide 166 and inner rod 162. Portions of the flux guides are interrupted to allow suspension arms 174 and 176 to contact outer housing 171.

The embodiment of FIGS. 10A-10B depict three suspension arms on either side of voice coil 172, but any number and combination of suspension arms can be used. Suspension arms 174 and 176 are integrated into sleeve 168 to ease construction of the device, in some instances integration of suspension anus 174 and 176 is not required.

According to another embodiment, a hearing aid device and/or actuator need not be circular, but may be in the form of an ellipse, rectangle or other shape. Similarly, components of a hearing aid device do not need to be monolithic. For example, a ring magnet is shown in the embodiments above but this magnet can be replaced by two or more other magnets to help form a desired shape.

FIG. 11 depicts a simplified diagram of a hearing aid device configuration according to one or more embodiments. Hearing aid device 177 includes microphone 178 connected to circuitry 180. Circuitry 180 can contain a power source, drive electronics, control electronics, signal processing, charging elements and/or charging circuitry. Components 184 and 186 of hearing aide device 177 form electromagnetic actuator 190, and component 182 provides a spring element between components 184 and 186.

Component 182 can be a spring or flexure element, such that the configuration of FIG. 11 allows actuator 190 to displace and provide a preload force against the object it is driving. In one embodiment, contact point 188 is connected to actuator 190 and interfaces with the ossicles. Sound received by microphone 178 is transmitted to circuitry 180. Circuitry 180 can perform signal processing operations on the microphone signal, (e.g. amplification, filtering). The processed signal from circuitry 180 is used to drive actuator 190 which ultimately drives the ossicles of the user and sound is perceived. In this way, hearing aid device 177 converts acoustic energy into mechanical energy that can be perceived as sound.

The housing of hearing aid device 177 can be designed to occlude the ear canal and block natural sounds from reaching the tympanic membrane, and thus, can also be used as a communication device in noisy environments. In this case, a hearing aid device would not drive the tympanic membrane based on the sound entering the ear (e.g. a typical hearing aid), but instead would drive the tympanic membrane based on a signal transmitted to the hearing aid device by another device (e.g. cell phone, mp3 player). This signal can be transmitted by wired or wireless means to the hearing aid device. Since the hearing aid device directly drives the tympanic membrane, there are no occlusion effects even though the entire ear canal is blocked. In this application, it may not be necessary to have the hearing aid device completely hidden in ear canal and, in fact, a visible device offers several advantages. First, it would be easy to determine if the user was wearing ear protection. Second, the user would have easy access to controls for adjusting settings of the device such as adjusting the volume and switching between different communication channels. Third, the user can remove the device without the aid of special equipment or assistance of another person.

FIG. 12 depicts a block diagram layout of a preload force and actuator in series which may be employed by a hearing aid device according to one or more embodiments. Schematically, the preload force is displayed as spring 192, the actuator is displayed as force element 194 and the interface tip is labeled 196. When preload force element 192 is displaced, a force is generated to oppose the direction of motion. The opposing force can be independent of, proportional to, or a complex function of the displacement. Force applied by force element 194 will be transmitted to interface tip 196 and will be reacted by preload force element 192. Unlike the layout shown in FIG. 5, the preload force and actuator force in FIG. 12 are dependant on each other since one must react the other. The preload force applied by preload force element 192 will still be able to hold interface tip 196 against the tympanic membrane with the force going through force actuator 194. This configuration enables actuators that have no floating travel to drive the tympanic membrane. Non-floating actuators include, but are not limited to, piezoelectric actuators, balanced armatures, solenoids, pneumatic actuators, and electromagnetic actuators. The effects on performance from preload force element 192 reacting the force of actuator 194 are reduced if the preload force needed to comfortably hold interface tip 196 against the tympanic membrane is much larger than the force needed to drive the tympanic membrane to produce sound. Even if the preload force is smaller than the actuation force, movement can still be transferred to the tympanic membrane. Configuration of such a device would be similar to the basic device configuration shown in FIG. 11, but instead of actuator 190 being composed of two parts, one attached to the housing (184) and the other attached to the moving element (186), the actuator would only be attached to the moving element. This change in actuator location results in the preload force and actuator being arranged in series and enables non-floating actuators to be utilized for driving the tympanic membrane.

Figure 13A:
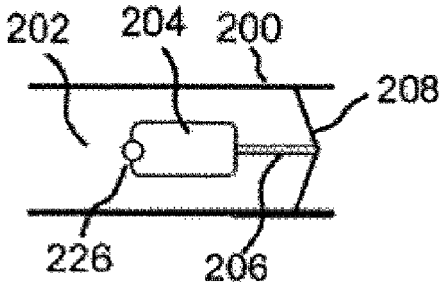
FIGS. 13A-13F depict various methods to reduce or eliminate feedback according to one or more embodiments.
Figure 13B:
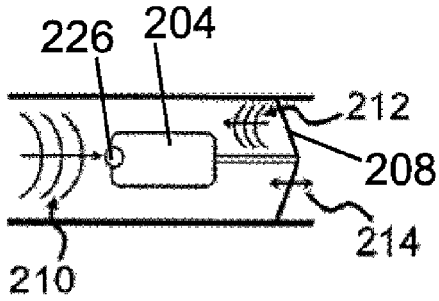

FIGS. 13A-13F depict graphical representations of a hearing aid device configured to reduce or eliminate feedback according to one or more embodiments. FIG. 13A is a schematic diagram of hearing aid device 204 in ear canal 202. Interface probe 206 enables hearing aid device 204 to actuate tympanic membrane 208. Microphone 226 is used to record sound entering the ear. Attachment of the hearing aid device 204 to ear canal wall 200 is not shown. FIG. 13B depicts sound 210 traveling towards tympanic membrane 208. Actuation, as shown by 214, of tympanic membrane 208 could produce sound 212 that would travel away from tympanic membrane 208. If sound 212 has sufficient intensity to be picked up by microphone 226, it could produce feedback within the direct hearing system. To reduce this feedback, several methods can be employed. In one embodiment, a directional microphone can be positioned to be most sensitive to sound traveling towards tympanic membrane 208. This method would reduce the sensitivity of direct hearing microphone to sounds traveling away from the tympanic membrane and therefore reduce the amount of feedback in the direct hearing system. Another method of reducing feedback would be the use of baffling around device 204 to reduce the intensity of sound 212. Sound 210 would reach microphone 226 before reaching the baffling, whereas sound 212 would travel past the baffling, reducing its intensity, before reaching microphone 226.

Figure 13C:
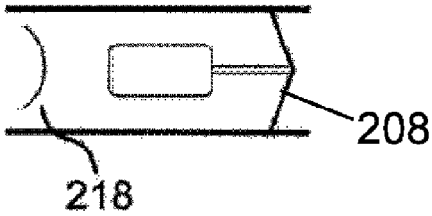
Figure 13D:
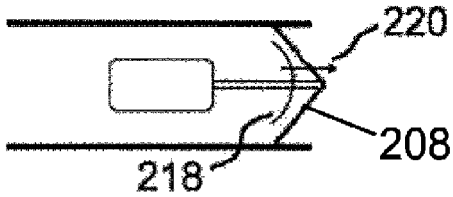

Another method, shown in FIG. 13C and FIG. 13D, is to actuate tympanic membrane 208, depicted as 220, in response to sound 218 at the same time sound 218 contacts tympanic membrane 208. In this method, positive (and negative) pressures of sound 218 will coincided with negative (and positive) pressures produced by actuation 220 and effectively cancel each other out, much like a noise cancelation system. This method also increases the efficiency of actuation 220 since sound 208 will aid in the movement of tympanic membrane 208.

Figure 13E:
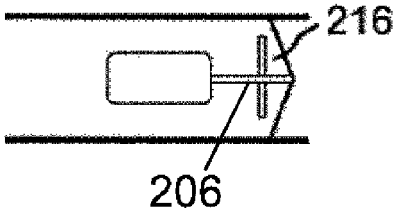

Another method includes using a sound inhibiting element to reduce the sound generated by the actuation of tympanic membrane 208. As shown in FIG. 13E, component 216 on interface probe 206 is a sound inhibiting element. Component 216 is designed in such a way that it would behave as a "bad speaker" and reduce the amount of sound generated during the movement of tympanic membrane 208. Another embodiment of this method, not shown, is to have the sound inhibiting component attached to the surface of tympanic membrane 208. This component would have similar sound inhibiting properties as element 216.

Figure 13F:
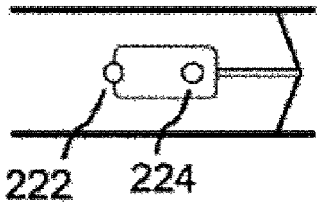

FIG. 13F displays a method of using microphones 222 and 224 to help reduce feedback. One method using this microphone configuration is to use the timing information between the sound received at microphone 222 and microphone 224. This timing information will help determine the direction of sound travel of a particular waveform and can be used in a filter algorithm to attenuate the sound traveling away from tympanic membrane 208. Another method using the microphone configuration is to have a directional microphone at position 222 that faces away from the tympanic membrane and a directional microphone at position 224 that faces towards the tympanic membrane. This method will also enable a filter algorithm to determine the direction a particular sound wave is traveling and can be used to attenuate the sound traveling away from tympanic membrane 208.

If sound 212 is not a component of sound 210, a filter can be used to reduce the feedback by reducing any frequency components not within the operating range of the device or the sound entering the ear.

FIGS. 14A-14D depict methods of positioning and attaching a hearing aid device with external components. As shown in FIG. 14A, hearing aid device 232 can be positioned and held in place by location component 230. Location component 230 is separate from device 232 and would remain with the user on removal of device 232. Location component 230 could be fixed in numerous ways including to the skin of ear canal 234, under the skin, or cemented to the bone. Location component 230 and attachment points on device 232 could be made from ferromagnetic and/or magnets. As such, device 232 would be held in place by magnetic forces between itself and location component 230 and therefore would not need to penetrate through the skin. Location component 230 would aid in the placement of hearing aid device 232 by providing a repeatable and reliable method of attachment. This would reduce the precision needed when placing device 232 and enable more frequent removals.

FIG. 14B shows location component 236 as a complete ring that would encompass ear canal 234. FIG. 14C shows location component 238 as a partial ring that would be placed on one side of ear canal 234. FIG. 14D shows location component 240 as multiple components that would be placed around ear canal 234. In this case, three components are shown for location component 240, but there could be any number of location components.

FIG. 15 depicts the use of an external fan to help keep the ear canal clean and dry. As shown in FIG. 15, air 250 from device 252 is directed into the ear canal by fan 254. Device 252 could be a wearable device or handheld device. Device 252 could also be integrated into hearing aid device 251. Device 252 would have an opening to allow air 250 to escape past it to aid in the air flow through the ear canal. Device 252 could also have a recharging unit, such as the one displayed by FIG. 6, integrated into the device to enable device 252 to both dry the ear canal and charge hearing aid device 251.

FIGS. 16A-16C depict methods of attaching a hearing aid device to allow free movement of particles, fluids, etc. around the device. As shown in FIG. 16A, hearing aid device 262 could be attached to the walls of the ear canal by attachment component 260. In a typical hearing device, attachment component 260 occludes the ear canal to reduce the potential for feedback. In this case, moisture and ear wax are trapped between the hearing aid device 262 and the tympanic membrane. Occluding the ear canal could lead to corrosion of the device, increased risk of infection and increased occlusion. To prevent these undesirable side effects, attachment component 260 could have openings around it and have limited contact with the ear canal. These openings can reduce the buildup of earwax by letting wax and/or other particles pass by hearing aid device 262, allowing free movement of air to reduce moisture and risk of infection, and reducing the occlusion effect since the ear canal will not be occluded. FIG. 16B and FIG. 16C are sectional views of FIG. 16A as shown by section line a-a. In FIG. 16B, attachment component 260 is composed of three components, one of which is labeled 264. The attachment components could be realized by one or more attachment components. Also, component 264 could be a single component with multiple attachment arms protruding from it. Since there is limited contact with the ear canal, the advantages of a non-occluding attachment can be realized by this configuration. In FIG. 16C, attachment component 260 is composed of component 266, which has numerous holes around its perimeter. These holes would offer a non-occluding attachment point.

According to one embodiment, winged attachment component 264 depicted in FIG. 16B can collapse during insertion and extend when placed properly in the ear canal to hold the hearing aid device securely in place. Alternatively, the winged attachment component could be held in the collapsed position with a sleeve that is removed after insertion or release by other mechanical, chemical or electrical means.

In another embodiment, a hearing aid device may include a moldable polymer housing to facilitate secure fitting within the ear canal. The polymer will be flexible in the patient's ear to assure comfort during all types of movement. The polymer housing may be cured through ultra violet light, and thus, customized for each patient after device placement within the ear canal. According to an embodiment, the application of UV curable polymers to a hearing aid device also extends to the contact tip placement and shape. A curable polymer may be placed around the interface tip, thus providing a secure contact and secure placement on the tympanic membrane. If the application calls for breathability of the housing where the ear canal should not be completely occluded, the use of a porous polymer may be integrated to eliminate moisture buildup and corrosion. This porous polymer may be self assembling, or created through the use of a biodegradable mesh. Application of the polymer may include placing a mesh for a hearing device, and injecting a polymer mold to follow. After a chosen time period, the mesh will dissolve leaving a customized, breathable polymer housing. The housing may be waterproof to allow for swimming, showering, etc. without causing damage to the device.

Figure 17A:
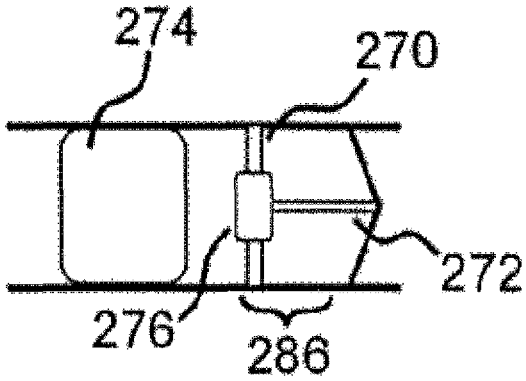
FIGS. 17A-17B depict hearing aid device associated with a two-part configuration according to one embodiment.
Figure 17B:
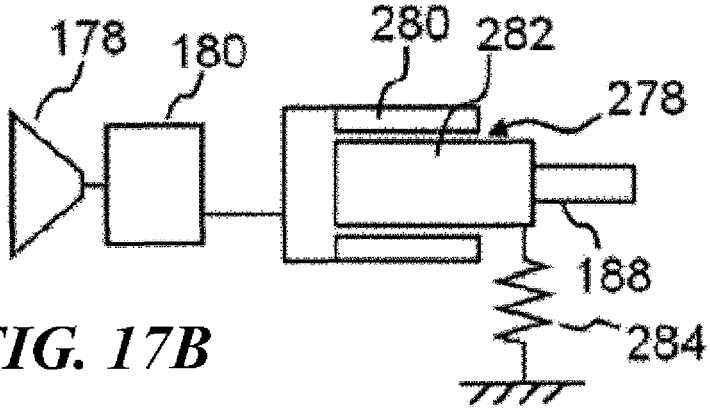

FIGS. 17A-17B depict a two-part embodiment of a hearing aid device. FIG. 17A shows a schematic of a two-part hearing aid device. Component 274 forms one part of the embodiment and components 286 forms the other part. In part 286, attachment 270 attaches to the wall of the ear canal and provides compliance between the ear canal and magnet 276. Passive magnet 276 can be driven by active component 274 to displace the tympanic membrane through interface 272. Active component 274 would have an electromagnet that could control magnet 276 without making contact with part 286. Since component 286 is passive and does not require a local power source, it can be made small, light and have a more permanent attachment to the user. This construction allows a skilled professional to locate and attach passive part 286, since part 286 does not need to be removed to change batteries. Part 274 could then be removed and replaced with greater ease since it is not as tolerant to position and would not make contact with the tympanic membrane.

FIG. 17B shows a simplified diagram of a two-part device configuration. The active part is formed by microphone 178, circuitry 180 and component 280. The passive part is formed by component 282, component 284 and interface probe 188. Microphone 178 is connected to circuitry 180. Circuitry 180 can contain a power source, drive electronics, control electronics, signal processing, charging elements and/or charging circuitry. Components 280 and 282 form electromagnetic actuator 278 even though they are located on different parts of the device. Part 280 can move relative to part 282 without affecting the force in interface probe 188, and therefore, the active part can be removed without disturbing the passive part of the device. Component 284 provides an element between component 282 and the ear canal which can be a spring or flexure element. This configuration allows component 282 to displace and provide a preload force against the object it is driving. Interface probe 188 is connected to component 282 and interfaces with the ossicles. Sound received by microphone 178 is transmitted to circuitry 180. Circuitry 180 can perform signal processing operations on the microphone signal, (e.g. amplification, filtering). The processed signal from circuitry 180 is used to drive actuator 190 which ultimately drives the ossicles of the user and sound is perceived. In this way, the device converts acoustic energy into mechanical energy that can be perceived as sound in a two-part configuration.

Figure 18:
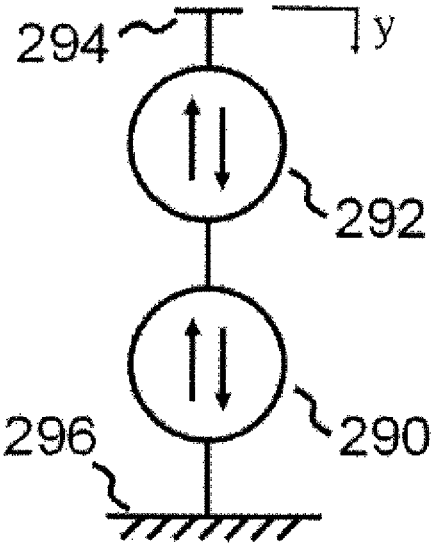
FIG. 18 depicts a schematic of a hearing device with an active suspension element according to one embodiment.

FIG. 18 depicts a schematic of a hearing device with an active suspension element according to one or more embodiments. The device of FIG. 18 may be an alternative arrangement for achieving a similar interface tip as discussed above with reference to FIG. 5. Actuators 290 and 292, and an interface tip 294 allows for an actuator with no floating travel to decouple its internal stiffness from the contact pressure. Non-floating actuators include, but are not limited to, piezoelectric actuators, balanced armatures, solenoids, hydraulic actuators, pneumatic actuators, and electromagnetic actuators. In one embodiment, actuators 290 and 292 are non-floating actuators. Actuator 290 would have a relatively low internal stiffness and could arbitrarily adjust the force on interface tip 294. This enables actuator 290 to behave as an active spring element that can adjust the force in interface tip 294 based on any number of parameters including contact pressure, displacement, tip velocity, etc. During the actuation of actuator 292, actuator 290 could provide a reaction force that reduces coupling between the contact pressure and actuation force. This allows actuator 292 to have a large internal stiffness, such as a piezoelectric actuator, but still have large displacements and low contact pressures during device placement. This configuration is not limited to non-floating actuators and could include floating actuators in place of one or more of the non-floating actuators discussed above.

Figure 19A:
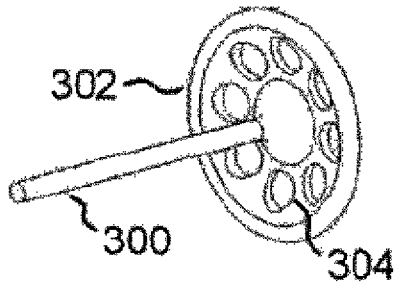
FIGS. 19A-19B depict contact probe geometries to reduce the contact area on the tympanic membrane according to one embodiment.
Figure 19B:
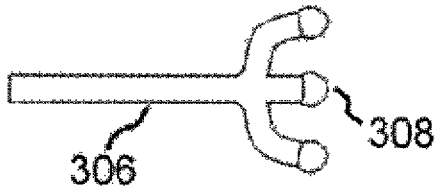

FIGS. 19A-19B depict contact probe geometries to reduce the contact area on the tympanic membrane. FIGS. 19A-19B display two types of interface probe geometries. Reduced contact area is desirable to allow the tympanic membrane to breath and reduce the chance of infection and irritation. In FIG. 19A, shaft 300 attaches to contact shape 302. Not shown is the hearing device that drives shaft 300. Contact shape 302 has numerous holes, one of which is labeled 304. This construction enables the contact shape to contact a large portion of the tympanic membrane while minimizing the area that is covered by the contact geometry. In FIG. 19B, shaft 306 attaches to a contact shape with multiple contact points, one of which is labeled 308. Not shown is the hearing device that drives shaft 306. This construction enables contact shape 302 to contact the tympanic membrane at multiple locations while minimizing the area covered by the contact tips. This construction distributes the load on the tympanic membrane while keeping the contact area to a minimum. The contact tip that is coupled to the umbo can be customized for each user for optimal function and fit.

According to another embodiment, a slippery, nonstick material could be used to construct or coat the contact area of the interface probe. The material/coating would allow water, debris, earwax, etc. to be carried away by the natural movement of the skin on the tympanic membrane. This would also reduce the moments that would be generated on the interface probe while contacting the tympanic membrane.

Another method to keep the tympanic membrane clean is to retract the interface probe during non-use and/or sleep periods. This method will enable the tympanic membrane to dry and reduce the amount of build up on the tympanic membrane. Retraction of the interface probe could be initiated by the user, based on one or more of the time of day, level of activity or on some other parameter. The retraction could be for long periods of time, such as during sleep, or could be at much shorter intervals, such as being in a quiet environment. During the retracted period, the interface probe could reengage with the tympanic membrane if a sound level above a specified threshold is measured. A power switch may be incorporated to improve upon battery life and extend the time between necessary charging periods. This power switch may correspond directly with the retraction of the interface probe allowing for the natural movement of the skin on the tympanic membrane to remove debris.

Figure 20:
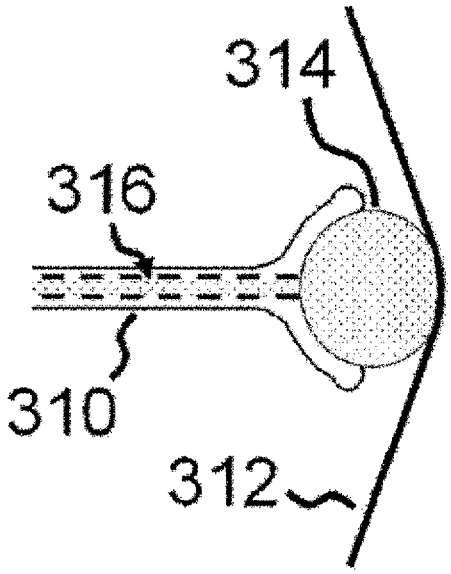
FIG. 20 depicts a process for using fluid between the contact probe and tympanic membrane according to one embodiment.

FIG. 20 depicts a process for using fluid between a contact probe and tympanic membrane. A simplified diagram is shown of contact between interface probe 310 and tympanic membrane 312. Fluid 314 is placed between contact probe 310 and tympanic membrane 312 to eliminate contact of tympanic membrane 312 with solid material. Since fluid 314 is the contact material, one or more of water, debris, earwax, etc. can be carried away by the natural movement of the skin of the tympanic membrane. Fluid 314 could be replenished by an external supply through transfer component 316. The external supply could be in the form of a reservoir on the hearing device that is supplied by the user or a doctor by a reservoir outside of the ear canal. Fluid 314 could be selected to reduce evaporation, such as oil, and/or could be a fluid that reduces the amount absorbed by the tympanic membrane. Transfer component 316 could be a tube that requires pressure to replenish fluid 314 or could be a wick, capillary or other component that able to replenish fluid 314 passively. In addition to fluid, this material that interfaces between contact probe and the tympanic membrane may be constructed of a soft flexible polymer. This material will still provide a delicate interface, while remaining robust for long term use.

Figure 21A:
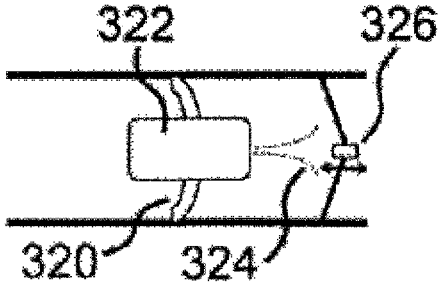
FIGS. 21A-21D depict utilizing an insert in the tympanic membrane for actuation according to one or more embodiments.
Figure 21B:
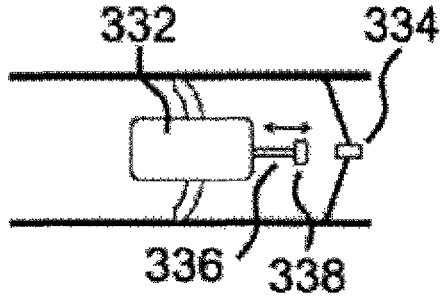

FIGS. 21A-21B depict one or more embodiments of utilizing an insert in the tympanic membrane for actuation. In FIG. 21A, device 322 is located in an ear canal and is attached via attachment 320. Insert 326 is fixed to the tympanic membrane. In one embodiment, a small incision is made into the tympanic membrane using a knife, needle, or other sharp device to fix insert 326. Insert 326 could be a small device shaped like a pressure equalization tube and may be placed into the tympanic membrane. The insert can be placed such that flanges on the inside and outside of the tympanic membrane hold insert 326 onto the tympanic membrane. In another embodiment of the device, the device can be anchored to the malleus or include a portion that sits against the malleus. Unlike traditional tubes inserted in the tympanic membrane, insert 326 can be a magnet, ferrous, paramagnetic or any other material that reacts to magnetic fields. Insert 326 is not required to be tubular and could be completely solid.

According to another embodiment, device 322 can transmit magnetic fields 324 that can influence and actuate insert 326. As such, device 322 can actuate the tympanic membrane without being in direct contact with the tympanic membrane. In the case that insert 326 is a magnet, device 322 can apply opposing forces on insert 326. Other methods for attaching insert 326 include use of one or more of adhesives, sutures, surface tension, or by any other means.

In FIG. 21B, device 332 has arm 336 with tip 338. Insert 334 is similar to insert 326 in FIG. 41A. Device 332 is capable of moving tip 338. Tip 338 could be a permanent magnet or an electromagnet. Tip 338 is able to transmit a magnetic field and therefore the mechanical movement of tip 338 will actuate insert 334. In the case that tip 338 is an electromagnet, the mechanical movement and electrically changing the magnetic field can produce intricate movements of insert 334.

Figure 21C:
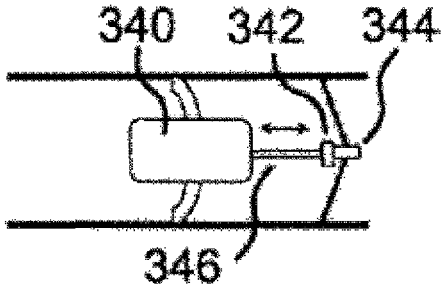

In FIG. 21C, device 340 has arm 346 with tip 342. Insert 344 is similar to insert 326 in FIG. 21A. Device 340 is capable of moving tip 342. Tip 342 mechanically attaches to insert 344 and enables device 340 to apply opposing forces on insert 344 and therefore the tympanic membrane. Tip 342 could be a permanent magnet or an electromagnet.

Figure 21D:
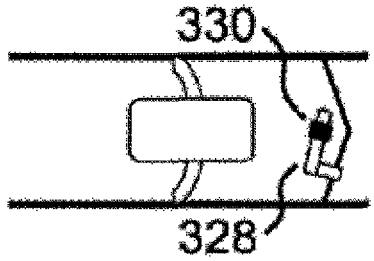

FIG. 21D illustrates an alternative configuration for an insert in the tympanic membrane. The insert is composed of attachment 328 and actuation material 330. Actuation material 330 reacts magnetic fields and can be of similar composition as insert 326 in FIG. 21A. The configuration of FIG. 21D enables actuation material 330 to be located at a different location than the attachment point to the tympanic membrane. The forces applied to the tympanic membrane via actuation material 330 will be different based on the location of the attachment point and actuation material 330. As such, forces that will be applied to the tympanic membrane may be customized.

Figure 22:
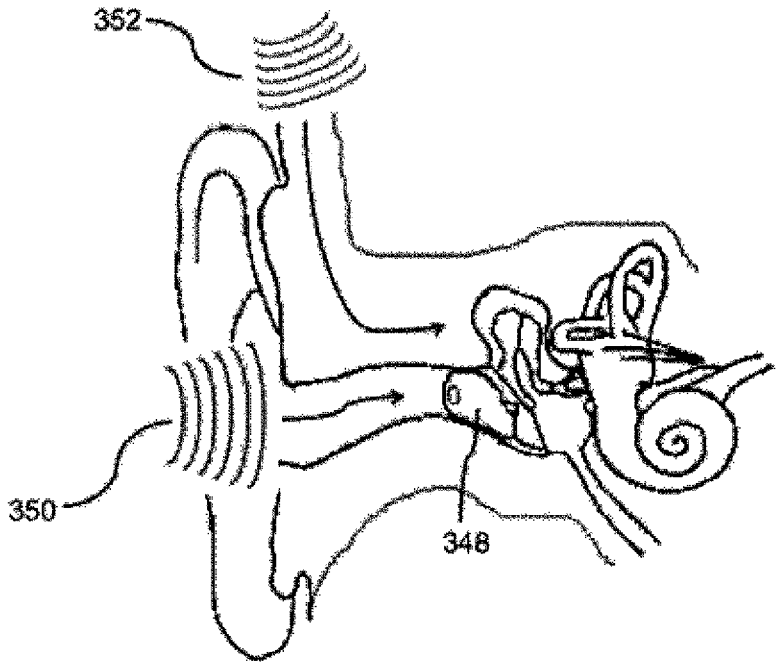
FIG. 22 depicts the use of direct hearing device as a protective hearing apparatus according to one embodiment.

FIG. 22 depicts the use of direct hearing device 348 as a protective hearing apparatus. Typical protective hearing devices passively or actively hinder sound entering through the ear canal, such as air conduction 350, but sound transmitted through the bones such as bone conduction 352, can still be heard and cause damage. Bone conduction hearing is caused by sound pressure waves that vibrate the skull and consequently the ossicular chain and fluid filled cochlea. However, since direct hearing device 348 will control the movements of the ossicular chain at the tympanic membrane, both mechanisms of sound transmission, that is bone conduction 352 and air conduction 350, can be modulated and reduced. To achieve this type of hearing protection, direct hearing device 348 would monitor the movement of the ear drum and actively prevent the ear drum from moving. A more sophisticated method of this hearing protection would involve filters and additional sound processing, to allow only wanted sounds to be transmitted and block unwanted sounds. For example, filters could filter out certain damaging sounds while still facilitating hearing of close conversational sounds. Sounds can also be transmitted by radio, either wired or wirelessly while still maintaining noise cancelling abilities through filtering and occlusion of the ear canal. In this case, the tympanic membrane is driven by an external signal as opposed to environmental sound entering through the ear canal. This will allow the user to hear the signal transferred over the radio, while outside environmental sounds will be cancelled. All parameters can be customized for specific applications.

While this disclosure has been particularly shown and described with references to exemplary embodiments thereof, it will be understood by those skilled in the art that various changes in form and details may be made therein without departing from the scope of the disclosure encompassed by the appended claims.

What is claimed is:

1. A hearing device comprising:

a microphone configured to receive sound;

an interactive tip;

an actuator including an actuator element and preload force element, the preload force element configured to place the interactive tip in contact with a portion of an ear, wherein the preload force element is separate from the actuator element; and circuitry coupled to the microphone and actuator, the circuitry configured to process sound received by the microphone and drive the actuator based on processed sound, wherein the actuator element is configured to drive the interactive tip relative to a portion of an ear based on one or more signals received from the circuitry.

2. The hearing device of claim 1, wherein energy is transferred to the portion of the ear by at least one of electronic, electromagnetic, acoustic, photonic, vibration, magnetic, and mechanical means.

3. The hearing device of claim 1, wherein the portion of the ear relates to one of an umbo, tympanic membrane, ossicles and section of the ear near the tympanic membrane.

4. The hearing device of claim 1, wherein the microphone is arranged on the hearing device to face an opening of an ear canal or tympanic membrane of the ear.

5. The hearing device of claim 1, wherein the actuator element is a voice coil actuator including a magnet, inner flux guide, outer flux guide, and voice coil.

6. The hearing device of claim 1, wherein the circuitry drives current through the actuator element to produce a force along or at an angle to the axis of the hearing device, the force driving the interactive tip.

7. The hearing device of claim 1, wherein the circuitry includes a power source, and one or more elements for driving, controlling signal processing, and charging the hearing device.

8. The hearing device of claim 1, wherein the interactive tip stimulates the portion of the ear or tympanic membrane to generate perceived sound.

9. The hearing device of claim 1, wherein housing can provide one or more of a seal for an ear canal, sound baffle for the tympanic membrane, a flexible outer surface and at least one feature to hold the hearing device in place.

10. The hearing device of claim 1, wherein the preload force element is a spring element, and the actuator is configured to provide free movement of the interface tip and to provide force towards the interface tip at any position of the interface tip.

11. The hearing device of claim 10, wherein the position of the interface tip does not influence force provided by the actuator.

12. The hearing device of claim 1, wherein the preload force element and the actuator element are arranged in one of a series and parallel relationship to drive the interface tip.

13. The hearing device of claim 1, wherein the actuator includes a magnet configured to form a flux circuit with an inner rod, first flux guide and a second flux guide, wherein at least one of an air and fluid gap exists between the second flux guide and the inner rod.

14. The hearing device of claim 1, wherein the interactive tip interfaces with the portion of the ear using a fluid.

15. The hearing device of claim 14, wherein the fluid is a fluid filled pouch configured to contact a tympanic membrane.

16. The hearing device of claim 1, wherein the interactive tip is a non-floating actuator.

17. The hearing device of claim 1, wherein the hearing device interfaces with a component in the ear to fix the position of the hearing device.

18. The hearing device of claim 1, wherein the hearing device can be charged by an ear worn device, the ear worn device charging the hearing device by one of wired and wireless charging.

19. The hearing device of claim 1, wherein the hearing device includes a non-contact stop mechanism configured to turn the hearing device off.

20. The hearing device of claim 1, wherein the hearing device includes means for reducing feedback to the hearing device.

21. The hearing device of claim 1, wherein interface tip drives an insert attached to a portion of the tympanic membrane by one or more of electromagnetic, mechanical, and photonic movement.

22. The hearing device of claim 1, wherein the hearing device includes one or more elements to reduce sound from reaching one or more of portions of the ear canal, tympanic membrane, middle ear, or inner ear.

23. A hearing device comprising:

an active section, the active section including a microphone configured to receive sound, a first actuator component, and circuitry configured to process sound received by the microphone and drive the first actuator component based on processed sound; and a passive section separate from the active section, the passive section including an electromagnetic actuator and interactive tip, wherein the electromagnetic actuator of the passive section is driven by the first actuator to drive a portion of the ear based on one or more signals received from the circuitry.

24. The hearing device of claim 23, wherein the passive section includes a preload force element for the interactive tip and the electromagnetic actuator.

* * * * *